United States Patent [19]

Johnson

[11] 4,073,365

[45] Feb. 14, 1978

[54] SPEAKER SYSTEM

[76] Inventor: Joseph W. Johnson, 802 E. 227th St., Bronx, N.Y. 10466

[21] Appl. No.: 814,302

[22] Filed: July 11, 1977

[51] Int. Cl.[2] ..... H04R 1/02; H04R 1/20

[52] U.S. Cl. ..... 181/147; 181/154; 181/199

[58] Field of Search ..... D14/33, 34; 179/1 E, 179/1 GA; 181/144, 145, 146, 147, 148, 154, 199

*Primary Examiner*—George G. Stellar
*Attorney, Agent, or Firm*—Fred L. Denson

[57] ABSTRACT

An audio speaker system designed to achieve multidirectional sound characteristics which includes an enclosure body having a base, front wall, two angled, forward sound directing side walls, at least one angled, inclined rear wall and a top wall which slopes downward from the rear wall to the front wall. At least one acoustic speaker is affixed to the top wall and to each of the front, side and rear walls of the enclosure body.

4 Claims, 4 Drawing Figures

FIG. 1
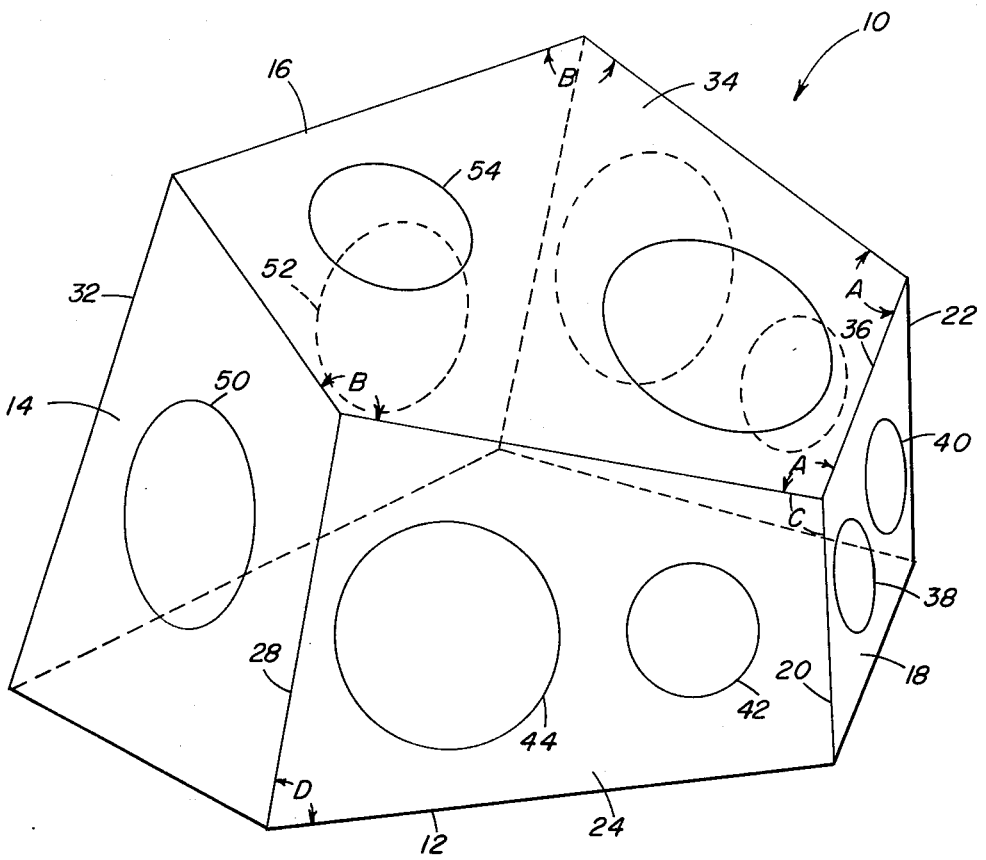
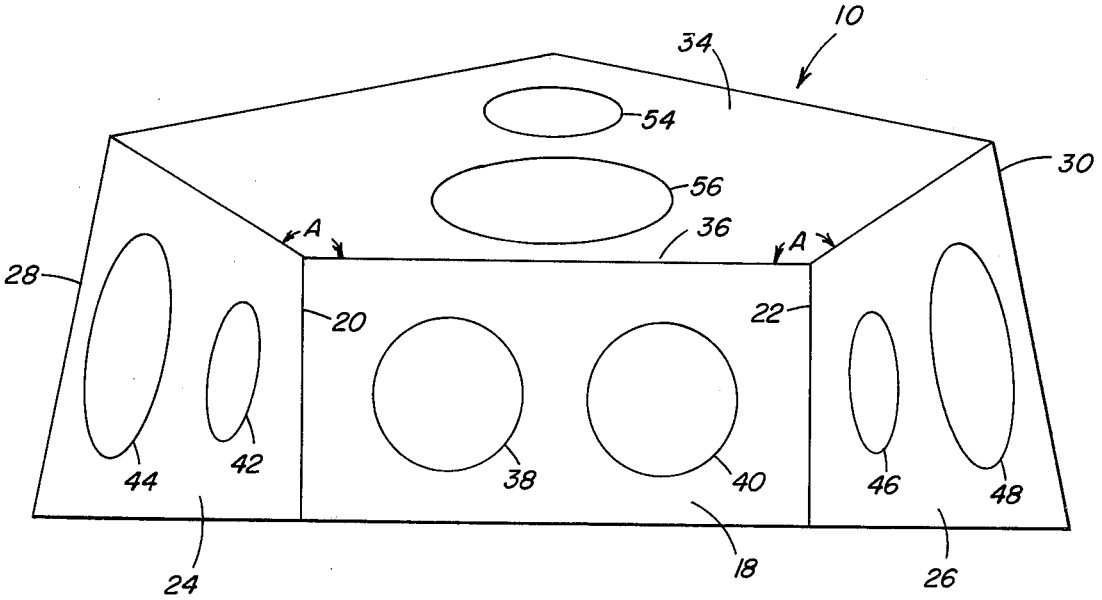
FIG. 2

SPEAKER SYSTEM

BACKGROUND OF THE INVENTION

1. Field of the Invention

The present invention relates generally to acoustical speaker systems and more particularly, to speaker systems having multidirectional sound characteristics.

2. SUMMARY OF THE INVENTION

While various speaker systems have been devised heretofore with the object of producing multidirectional sound characteristics, the configuration of the present invention is believed to provide an advantageous arrangement that is inexpensive to manufacture and assemble while providing high fidelity and multidirectional sound radiation characteristics in a structure having an inherently pleasing and utilitarian appearance.

The above-enumerated advantages of the present invention are achieved by a combination of speakers mounted within a cabinet adapted to be positioned in the corner of a room. In one embodiment, the cabinet is formed in the shape of a hexahedron and comprises a base, an upstanding front wall, two upstanding, angled side walls, an inclined rear wall and a top wall which slopes downward from the rear wall to the front wall. In a second, larger embodiment, the cabinet is formed in the shape of a heptahedron and comprises a base, front wall, two side walls and a top wall as in the first embodiment and two angled, inclined rear walls. In both embodiments, a plurality of speakers mounted within the cabinet issue sound from the top, front, side and rear walls. The sound issuing from the front wall is projected forwardly. The sound issuing from the two angled side walls is also projected forwardly but is reflected and accelerated by the adjacent room walls. The sound issuing from the top wall is projected upwardly and forwardly providing a more natural "sound decay" as such sound is coupled with the reflected sound originally issuing from the rear cabinet wall or walls.

The invention and its advantages will become more apparent by referring to the accompanying drawings wherein like reference numerals denote like parts and to the ensuing detailed description of the preferred embodiment.

BRIEF DESCRIPTION OF THE DRAWINGS

FIG. 1 is a perspective view showing the top, front, and left side and rear walls of a speaker system constructed in accordance with the teachings of the present invention;

FIG. 2 is a perspective view of the speaker system of FIG. 1 showing the top, front and left and right side walls;

DETAILED DESCRIPTION OF THE PREFERRED EMBODIMENTS

Figure 3:
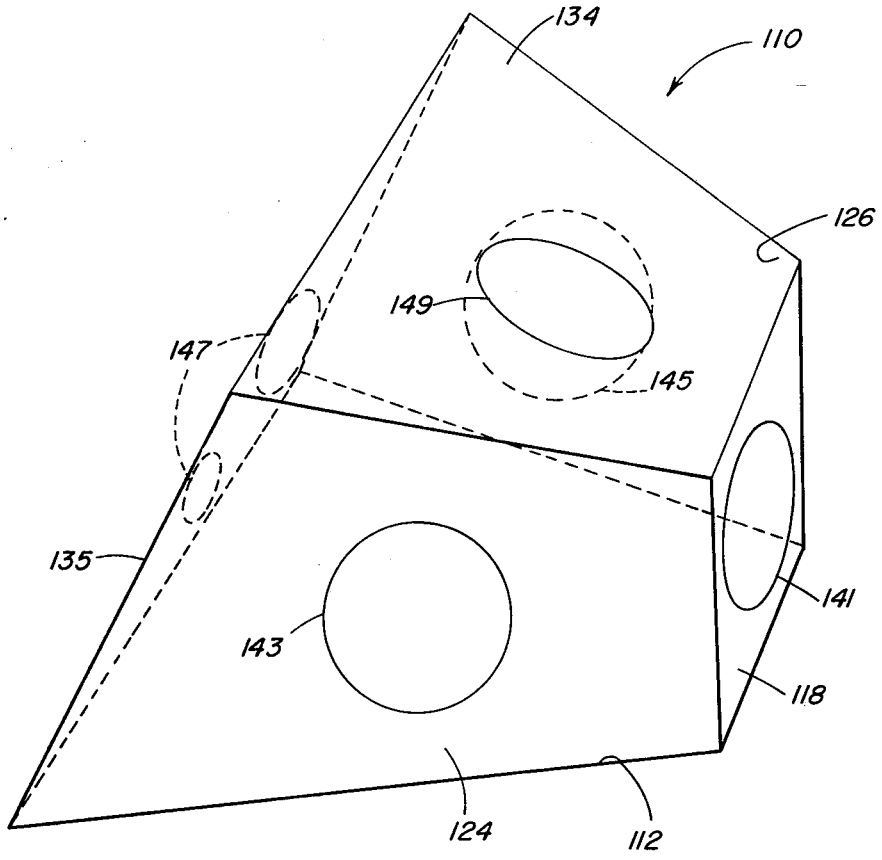
FIG. 3 is a perspective view of another embodiment of the invention.

Referring now to the drawings and in particular to FIGS. 1 and 2, there is shown an enclosure body or cabinet indicated generally by reference numeral 10. The cabinet 10 is preferably made of wool or other suitable inexpensive material and is of a shape adapted to be positioned in the corner of a room. In the embodiment shown in FIGS. 1 and 2, the cabinet 10 is in the form of a heptahedron which includes a flat bottom wall 12 that may be mounted on a suitable base (not shown) if desired. A vertically disposed front wall 18 extends upwardly from the bottom wall 12. Extending rearwardly from the side edges 20 and 22 of the front wall are a pair of side walls 24 and 26, respectively, which are vertically disposed relative to the bottom wall 12 and angularly disposed relative to the front wall 18 with the angle A between the side walls and the front wall being obtuse. Rear walls 14 and 16 continue rearwardly from the rear edges 28 and 30, respectively, of the side walls 24 and 26 at an obtuse angle and converge at a rear vertical edge 32. Furthermore, the rear walls 14 and 16 are inclined with respect to the bottom wall 12 and form acute angles D of intersection therewith. As shown in the drawings, the top wall 34 is in the shape of a pentagon and slopes downwardly from the rear vertical edge 32 to the top edge 36 of the front wall 18 with which it forms an obtuse angle C.

Each of the top, front, side and rear walls of the cabinet 10 include acoustic output areas covered with a sheet of cloth or fabric, by which sound waves are fed into the room. The front wall 18 has two acoustic output areas 38 and 40 behind which two conventional high frequency speakers or tweeters are mounted. The two side walls 24 and 26 each have two acoustic output areas 42 and 44 and 46 and 48, respectively. Two tweeters are mounted behind the output areas 42 and 46, respectively, and two conventional full range speakers are mounted behind the output areas 44 and 48, respectively. The rear walls 14 and 16 each have one acoustic output area 50 and 52 respectively, behind which a full range speaker is mounted. The top wall 34 also has two acoustic output areas 54 and 56. A tweeter is mounted behind the output area 54 and a full range speaker is mounted behind the output area 56.

In operation, the sound issuing from the output areas 38 and 40 in front wall 18 is projected forwardly and horizontally. The sound issuing from the output areas 42, 44, 46 and 48 in the sidewalls 24 and 26 is projected angularly and horizontally and utilizes the adjacent room walls to reflect and accelerate the sound for enhanced transient response. The sound issuing from the output areas 50 and 52 in the rear walls 14 and 16 is projected upwardly and rearwardly to the left and right, respectively, and upon reflectance from the adjacent room walls adds to the area of sound dispersion. The sound issuing from the output areas 54 and 56 in the top wall 34 is projected forwardly and upwardly and produces a more natural "sound decay" as such sound is coupled with the sound originally issuing from the rear inclined walls 14 and 16 and reflected by the rear room walls.

Another embodiment of the present invention is shown in FIG. 3. In this embodiment which functions in a similar manner to the first embodiment, the cabinet 110 is in the form of a hexahedron and comprises a flat bottom wall 112, a vertically disposed front wall 118, two rearwardly extending side walls 124 and 126 which are vertically disposed relative to the bottom wall 112 and angularly disposed relative to the front wall 118, an inclined rear wall 135 and a top wall 134 which slopes downwardly from the rear wall 135 to the front wall 118. A tweeter speaker is mounted behind an acoustic output area 141 in the front wall 118 and full range speakers are mounted behind acoustic output areas 143, 145, 147 and 149 in the two side walls 124 and 126, the rear wall 135, and the top wall 134, respectively.

Figure 4:
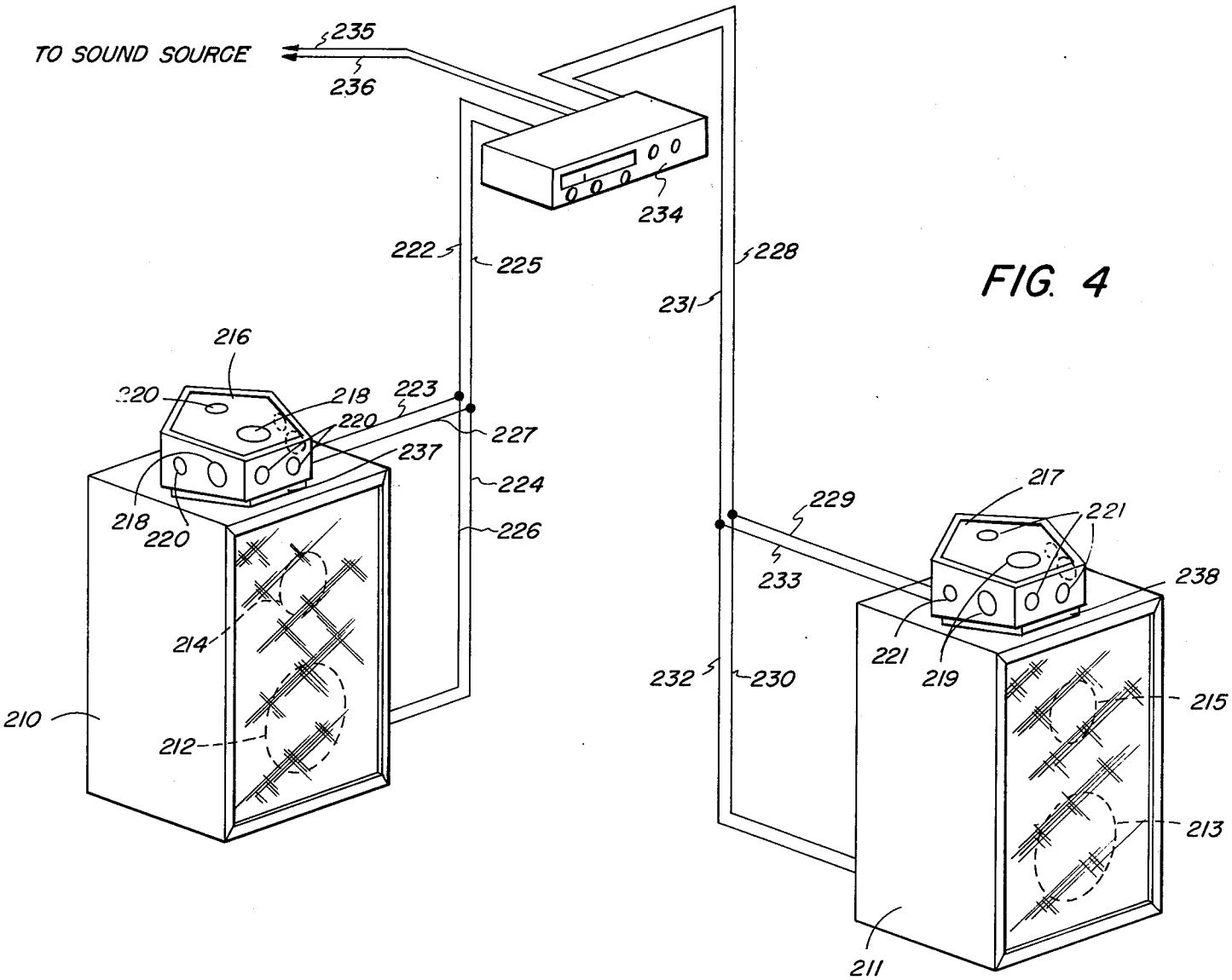
FIG. 4 is a perspective view of a speaker system.

As previously explained, the novel speaker assemblies described herein are ideally suited for corner positioning. However, since they are omnidirectional, they may also be placed so as to eminate sound waves in a 360° pattern. Moreover, while the assemblies may be singularly employed, they are particularly useful when used as an "add-on" speaker system to operate in conjunction with a full-range speaker system which generates low base. When used in this capacity, the combination of speaker systems very closely approximates the accoustical environment in which the recording works were originally produced and enables the listener to obtain a sense of the whole. FIG. 4 shows one of many useful add-on arrangements. The system of FIG. 4 includes a standard amplifier or amplifier-preamplifier combination 234 connected to a sound source such as a tuner, tape deck or turn table by lines 235 and 236. A pair of conventional free-standing floor speaker cabinets 211 and 210 containing full-range speakers mounted behind accoustical output areas 212 and 213 and tweeters mounted behind accoustical output areas 214 and 215 are connected to amplifier 234 by lines 226, 224, 222, 225, 232, 230, 231 and 228. The novel speaker assemblies of this invention 216 and 217 are positioned on pedestals 237 and 238 which are placed on the top side of cabinets 211 and 210 and are used as "add-ons". Speaker cabinets 216 and 217 are of the type shown and described in FIGS. 1 and 2 and contain tweeters mounted behind accoustical output areas 220 and 221 and full-range speakers mounted behind accoustical output areas 218 and 219 positioned in the previously described manner behind a suitable enclosure material. Speakers contained in cabinets 216 and 217 are connected to amplifier 234 by lines 223, 222, 227, 225, 233, 231, 229 and 228. Additional units may be employed in conjunction with quadraphonic sound sources. When employed as "add-ons", the novel speaker assemblies described herein are particularly useful in augmenting the high end response of floor standing and bookshelf type speaker systems.

From the foregoing, it can be readily seen that the configuration of the present invention provides effective multidirectional sound distribtuion in a compact and aesthetically pleasing structure of relatively low cost.

The invention has been described in detail with particular reference to preferred embodiments thereof but it will be understood that variations and modifications can be effected within the spirit and scope of the invention.

I claim:

1. A speaker assembly comprising an enclosure body having at least six surfaces including a bottom wall, an upstanding front wall, two upstanding side walls which intersect said front wall at an obtuse angle, at least one inclined rear wall which intersects said bottom wall at an acute angle and an inclined top wall which intersects said front wall at an obtuse angle, said enclosure body being provided with at least one acoustic speaker affixed to each of said front, side, rear and top walls.

2. The speaker assembly according to claim 1 wherein said front wall has a tweeter speaker affixed thereto and said top, side and rear walls each have a full range speaker affixed thereto.

3. A speaker assembly comprising an enclosure body having seven surfaces including a bottom wall, an upstanding front wall, two upstanding side walls which intersect said front wall at an obtuse angle, two inclined rear walls which intersect said bottom wall at acute angles and said side walls at obtuse angles, and an inclined top wall which intersects said front wall at an obtuse angle, said enclosure body being provided with at least one acoustic speaker affixed to each of said front, side, rear and top walls.

4. The speaker assembly according to claim 3 wherein said front wall has two tweeter speakers affixed thereto, each of said rear walls has a full range speaker affixed thereto, and each of said top and side walls has one tweeter speaker and one full range speaker affixed thereto.

* * * * *